US011634905B2

(12) United States Patent
Mikuriya

(10) Patent No.: US 11,634,905 B2
(45) Date of Patent: Apr. 25, 2023

(54) INSTALLATION AND CONSTRUCTION METHOD OF WALL PANEL

(71) Applicant: SEKISUI HOUSE, LTD., Osaka (JP)

(72) Inventor: Jun Mikuriya, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 0 days.

(21) Appl. No.: 17/297,194

(22) PCT Filed: Jan. 22, 2020

(86) PCT No.: PCT/JP2020/002034
§ 371 (c)(1),
(2) Date: May 26, 2021

(87) PCT Pub. No.: WO2020/158526
PCT Pub. Date: Aug. 6, 2020

(65) Prior Publication Data

US 2022/0025646 A1 Jan. 27, 2022

(30) Foreign Application Priority Data

Jan. 30, 2019 (JP) ..... JP2019-014151

(51) Int. Cl.
*E04B 1/00* (2006.01)
*E04B 2/70* (2006.01)
(Continued)

(52) U.S. Cl.
CPC ..... *E04B 2/707* (2013.01); *E04B 1/40* (2013.01); *E04B 2001/405* (2013.01)

(58) Field of Classification Search
CPC ..... E04B 2001/2648; E04B 1/40
(Continued)

(56) References Cited

U.S. PATENT DOCUMENTS 3,293,813 A * 12/1966 Emmons ..... E04B 2/7854 52/456
3,732,660 A * 5/1973 Byssing ..... E04B 2/7863 52/489.1
(Continued)

FOREIGN PATENT DOCUMENTS

JP 1994-158753 A 6/1994
JP 2010-121338 A 6/2010
(Continued)

OTHER PUBLICATIONS

International Search Report issued in application No. PCT/JP2020/002034.

*Primary Examiner* — Basil S Katcheves
(74) *Attorney, Agent, or Firm* — McClure, Qualey & Rodack, LLP

(57) ABSTRACT

An installation and construction method of a wall panel is provided for installing the wall panel to a pair of wooden columns and a wooden horizontal member, the wooden columns being installed in a standing manner so as to be spaced apart from each other, the wooden horizontal member being installed to the wooden columns. The method includes: forming the wall panel by connecting mutually adjacent end portions of a plurality of surface members in a horizontal direction by a half column extending in a vertical direction, studs being fixed on first plate surfaces of the plurality of surface members; and after installing the wooden horizontal member to the wooden columns and adjusting erection of the wooden columns, fixing edge end portions of the surface members of the wall panel to front surfaces of the wooden columns and a front surface of the wooden horizontal member.

4 Claims, 13 Drawing Sheets

(51) Int. Cl.
*E04B 1/41* (2006.01)
*E04B 1/38* (2006.01)

(58) Field of Classification Search
USPC ..... 52/745.09
See application file for complete search history.

(56) References Cited

U.S. PATENT DOCUMENTS 3,900,996 A * 8/1975 Yohe ..... E04B 2/7854 52/775
6,240,695 B1 * 6/2001 Karalic ..... E04C 3/02 52/657
6,318,044 B1 * 11/2001 Campbell ..... E04C 3/11 52/645
10,041,288 B1 * 8/2018 Flood ..... E04B 2/58
10,081,938 B2 * 9/2018 Acquistapace ..... E04B 1/2608
10,822,795 B1 * 11/2020 Wilson ..... E04B 2/7457
2001/0002529 A1 * 6/2001 Commins ..... E04B 1/26 52/514
2002/0108332 A1 * 8/2002 Timmerman, Sr. ... E04B 1/0007 52/712
2003/0041551 A1 * 3/2003 Boone ..... E04B 1/26 52/698
2004/0040255 A1 * 3/2004 Burness ..... E04B 1/24 52/474
2004/0074184 A1 * 4/2004 Naji ..... E04F 13/04 52/344
2004/0200178 A1 * 10/2004 Simmons ..... E04B 1/24 52/633
2008/0196332 A1 * 8/2008 Surowiecki ..... E04C 3/07 52/204.2
2009/0272051 A1 * 11/2009 Sipe ..... E04B 1/08 52/483.1
2010/0083606 A1 * 4/2010 Davis ..... E04B 1/24 52/656.9
2013/0067849 A1 * 3/2013 Espinosa ..... E04B 1/4128 52/699
2014/0345223 A1 * 11/2014 Miks ..... E04F 13/007 52/309.4
2018/0094423 A1 * 4/2018 Getz ..... E04C 3/06
2018/0094426 A1 * 4/2018 Winter ..... E04B 1/2403
2018/0127969 A1 * 5/2018 Acquistapace ..... E04B 1/1903

FOREIGN PATENT DOCUMENTS

JP 2016-125201 A 7/2016
JP 6383891 B1 8/2018

* cited by examiner

[FIG.1]
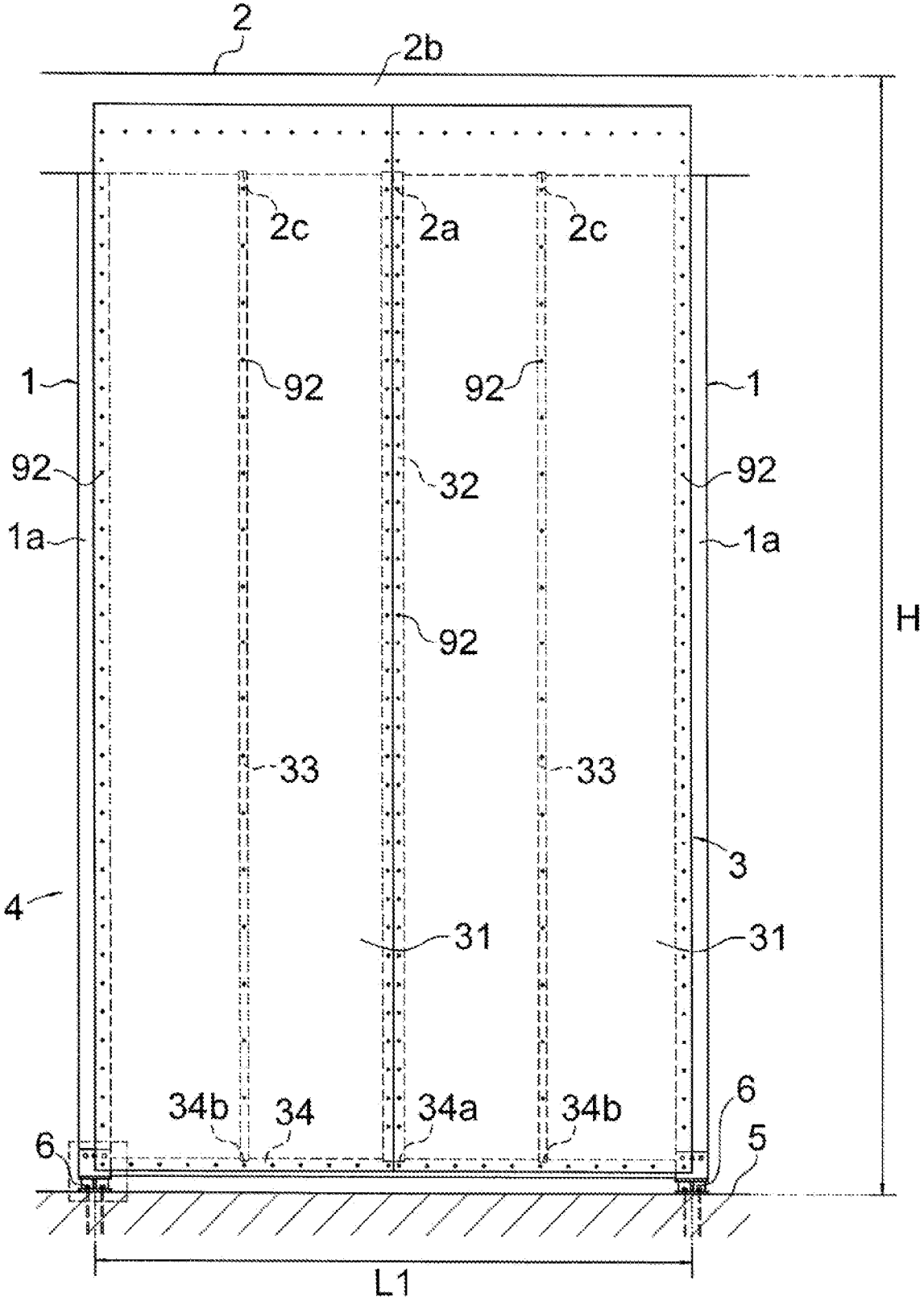

[FIG.2]
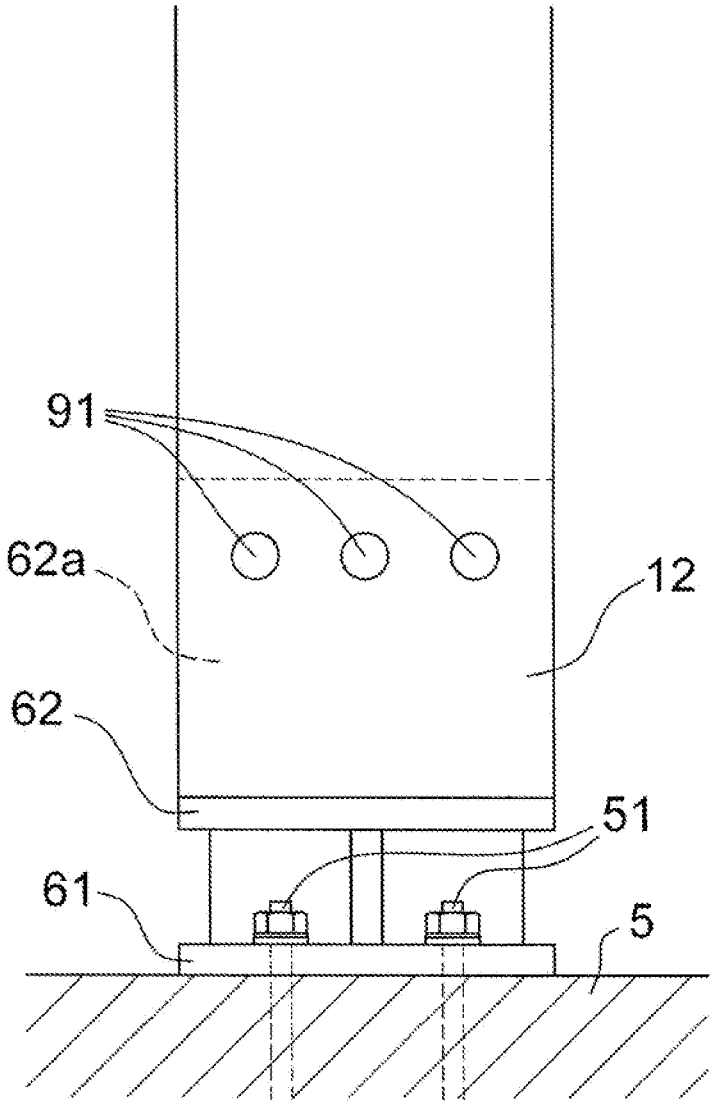

[FIG.3]
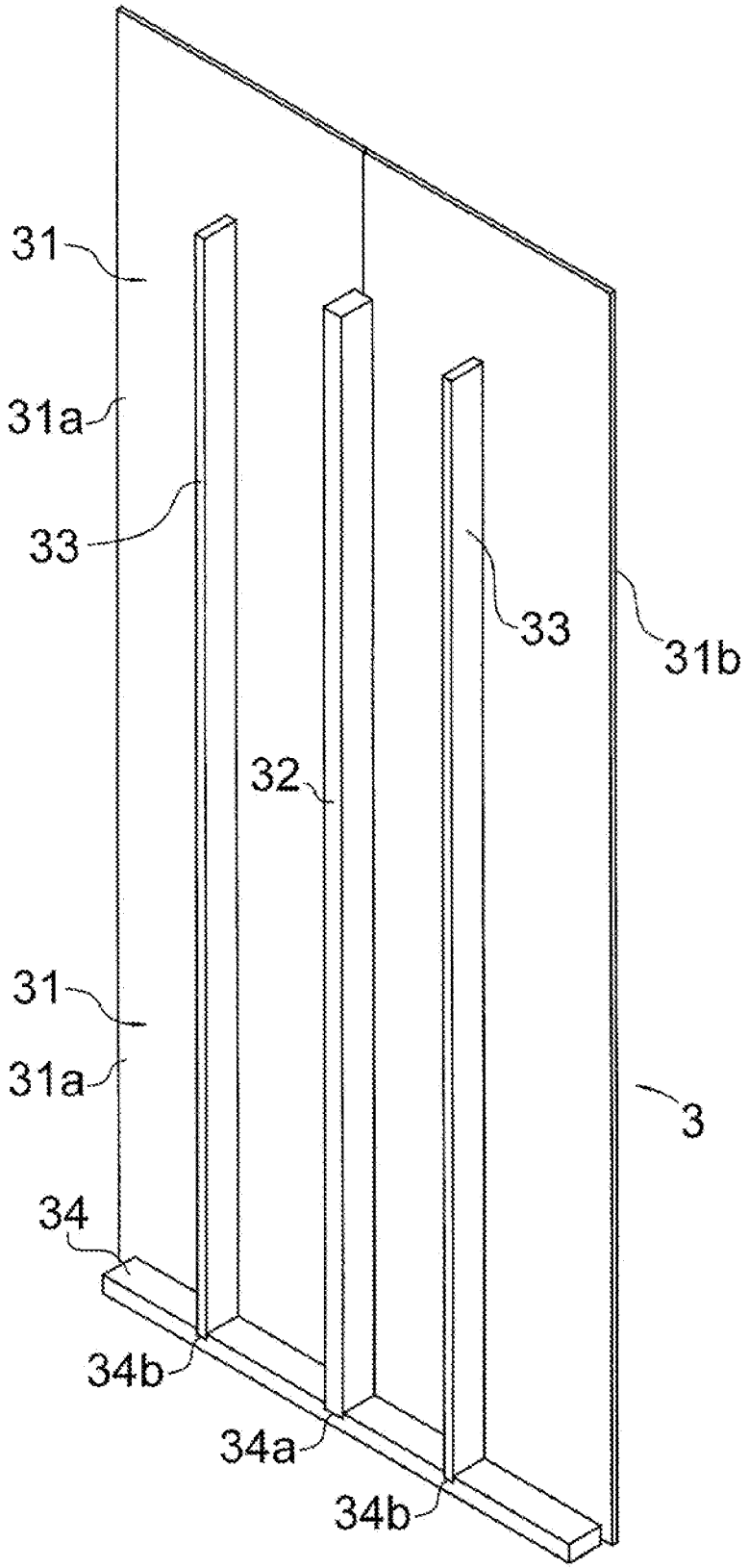

[FIG.4]
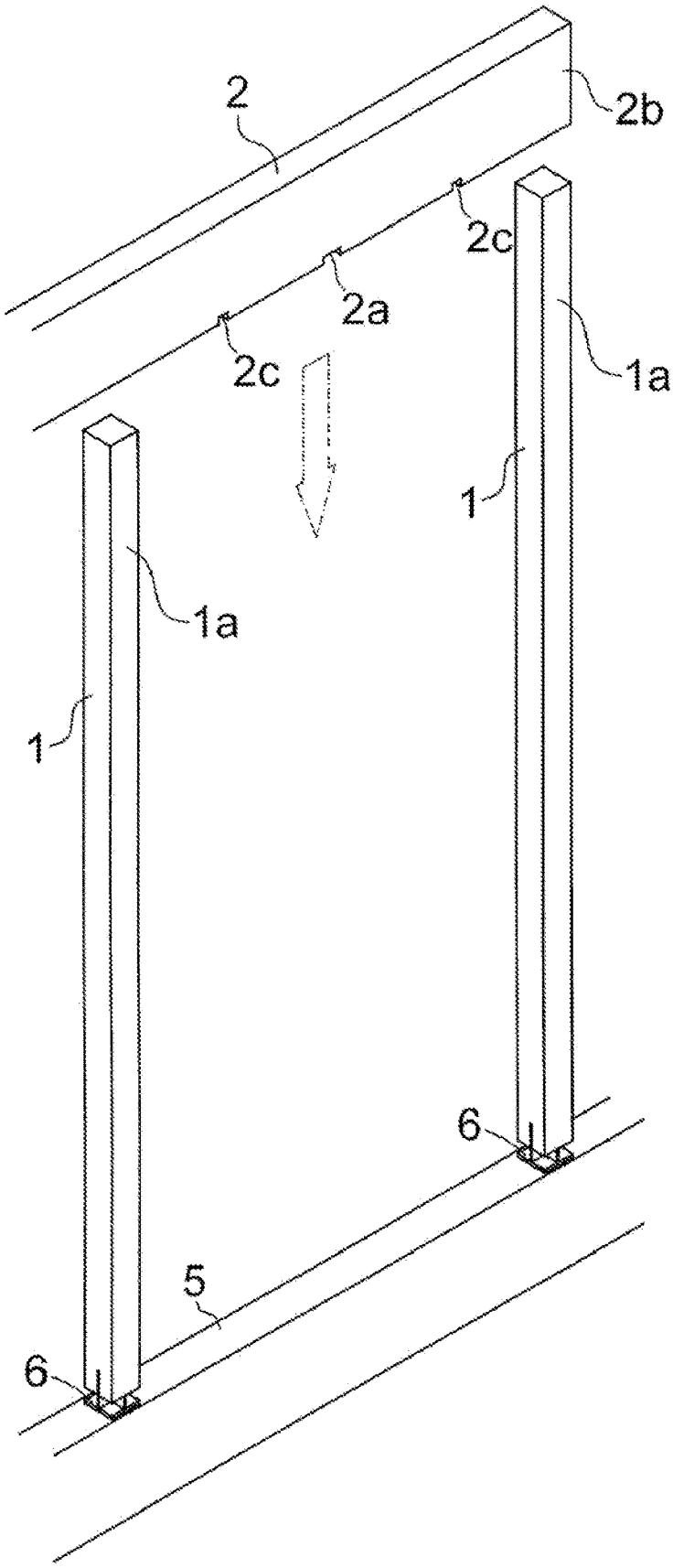

[FIG.5]
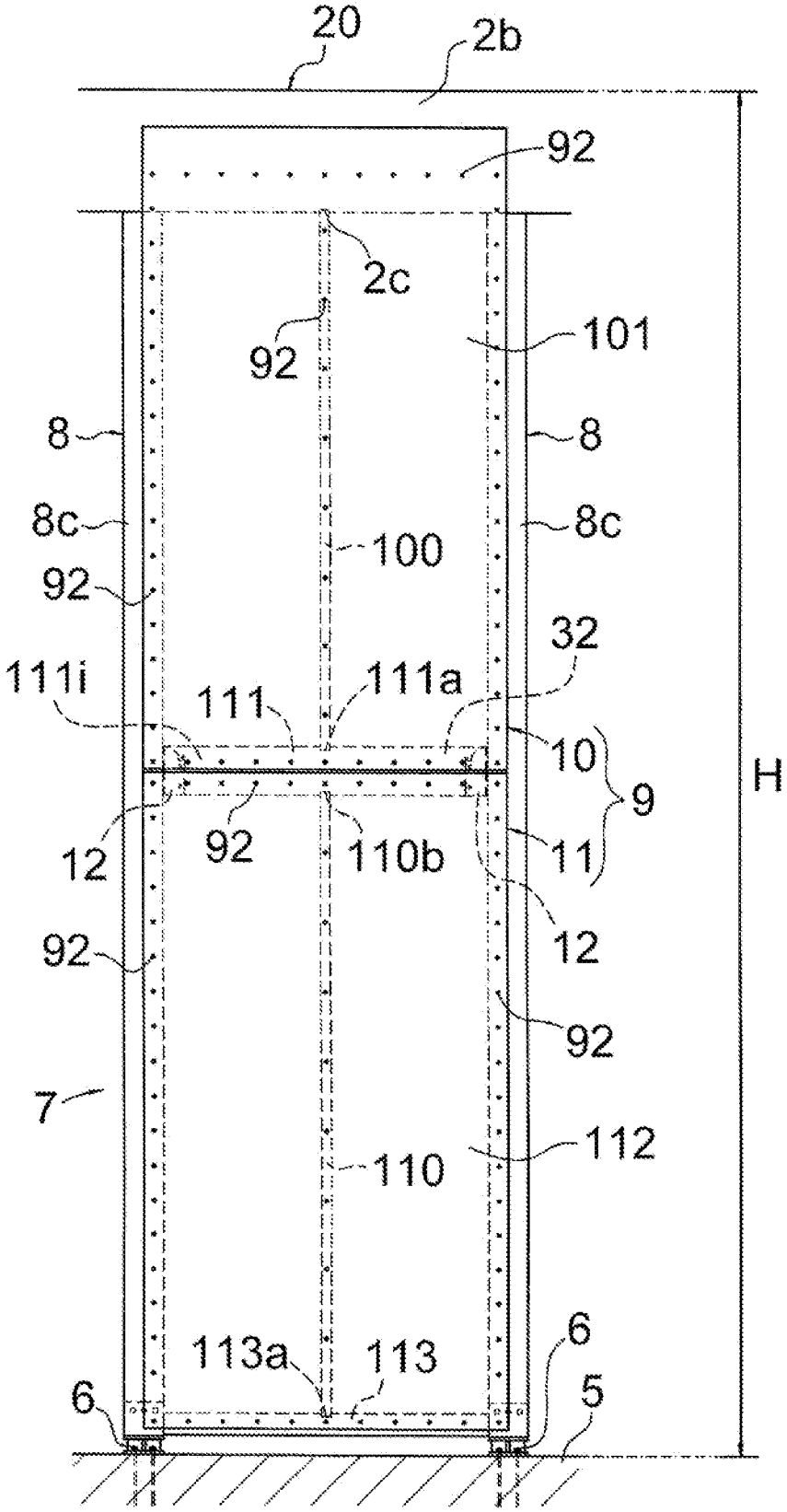

[FIG.6]
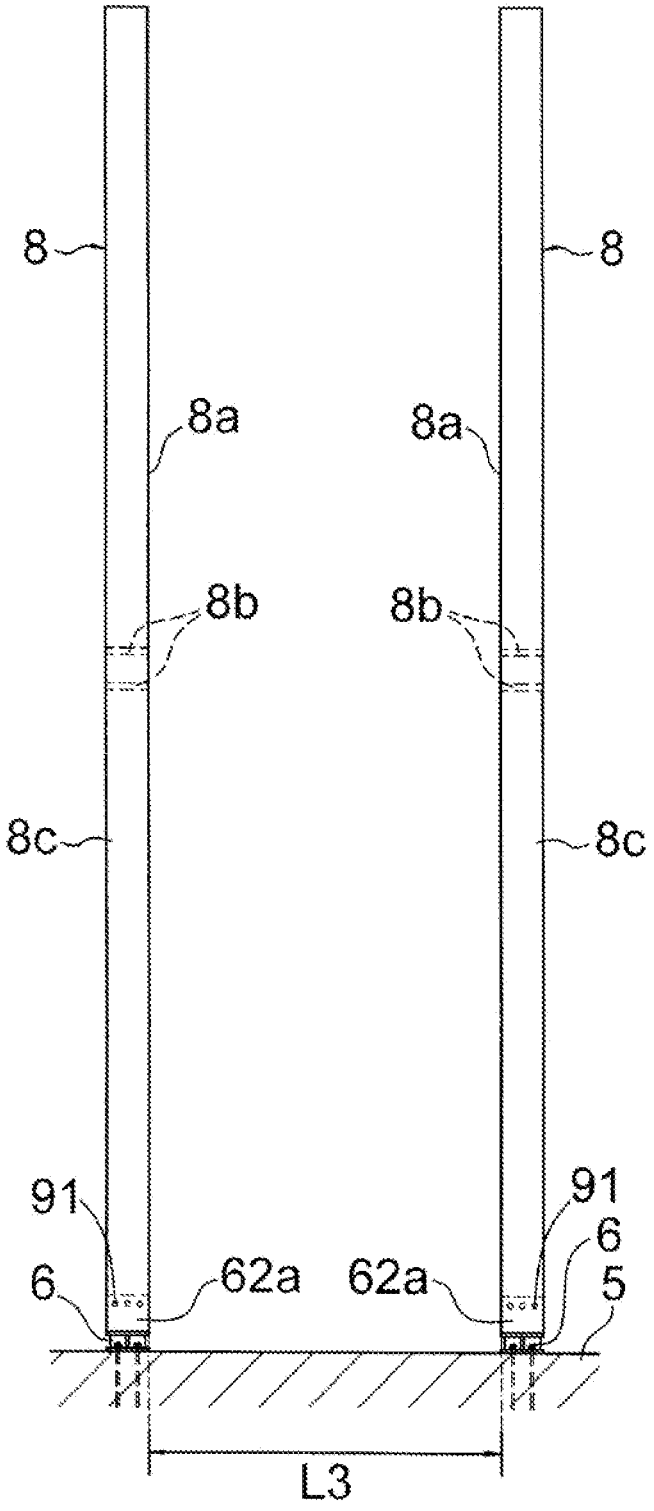

[FIG.7]
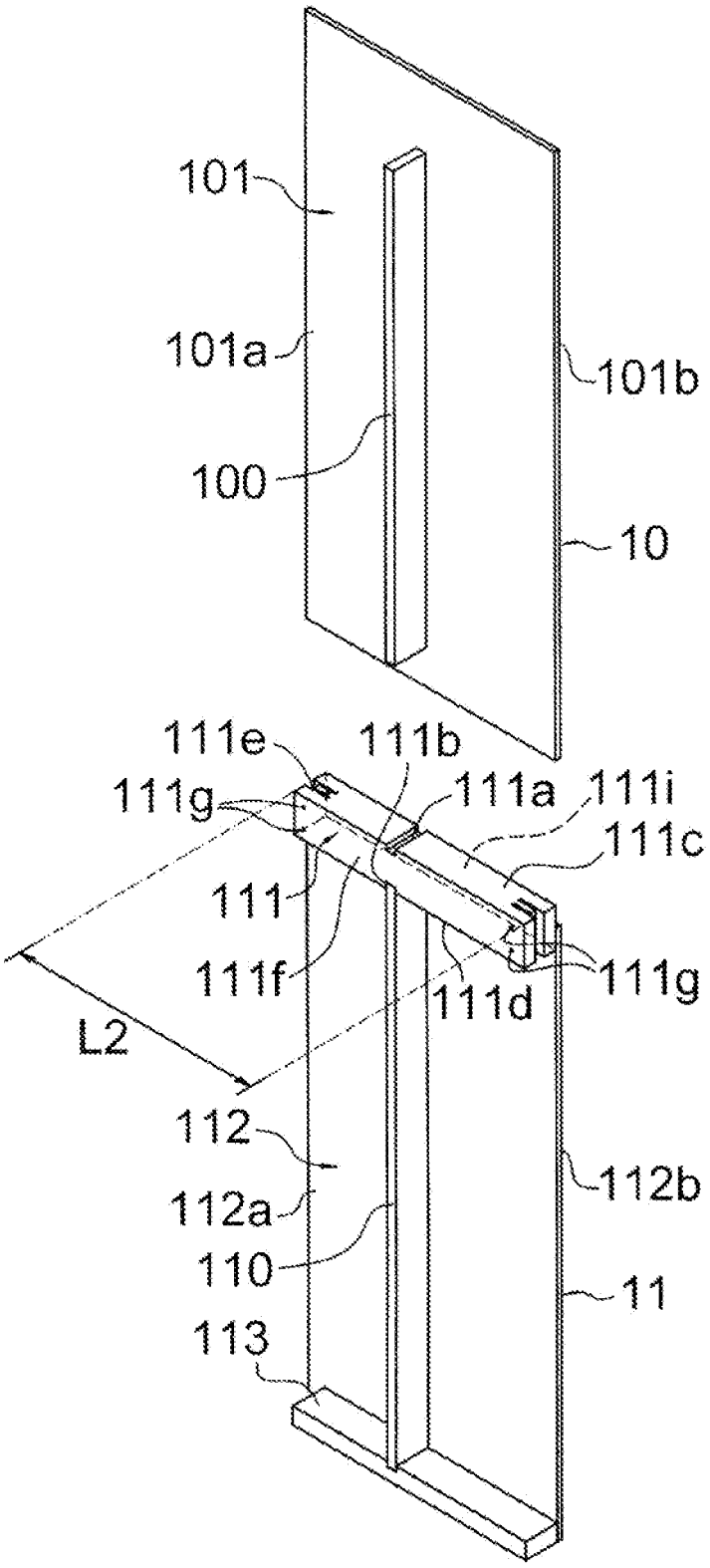

[FIG.8]
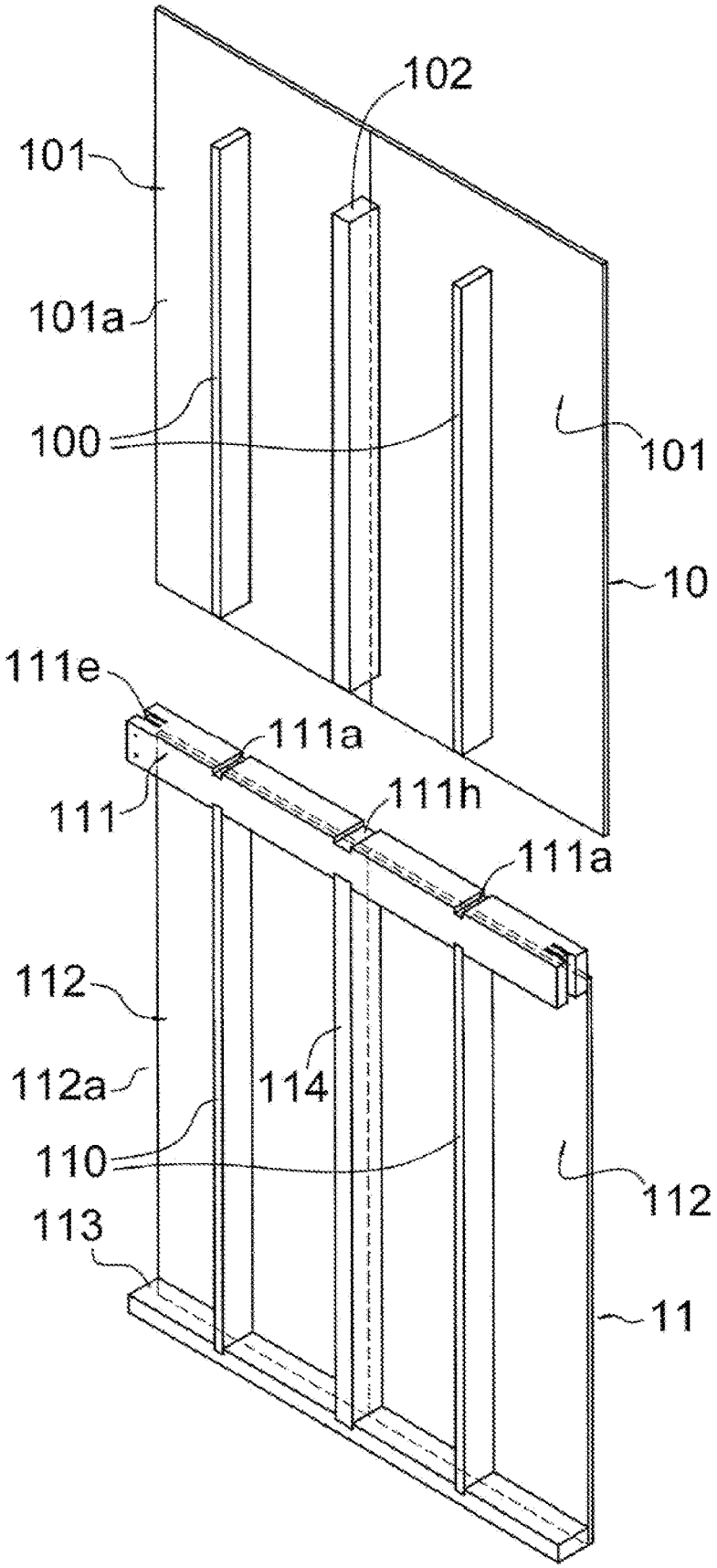

[FIG.9]
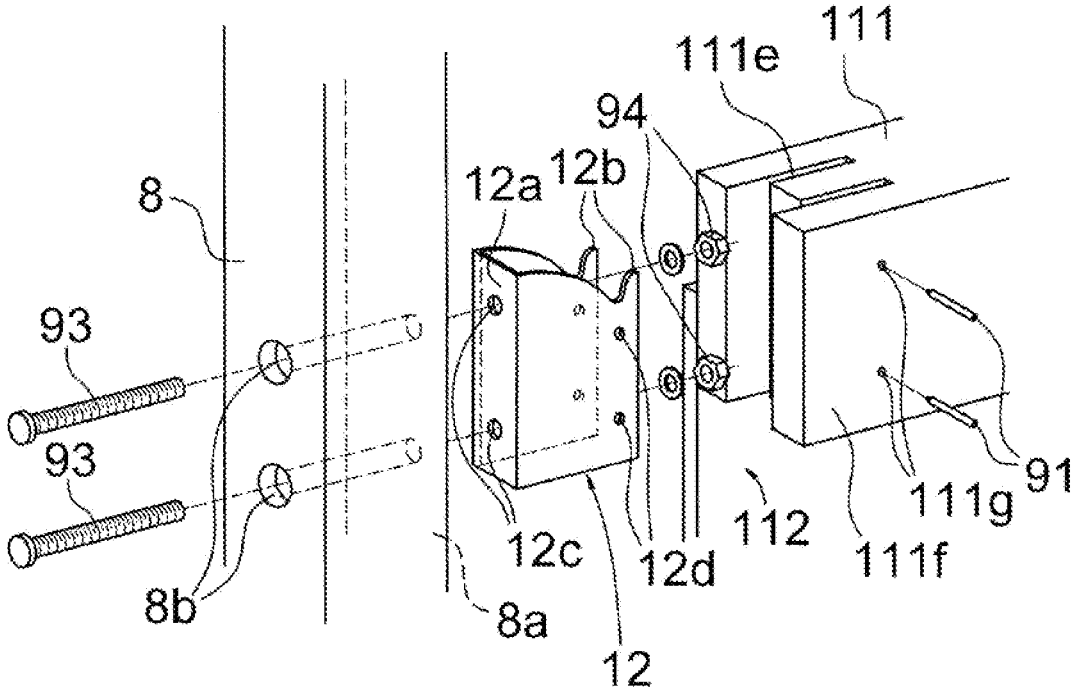

[FIG.10]
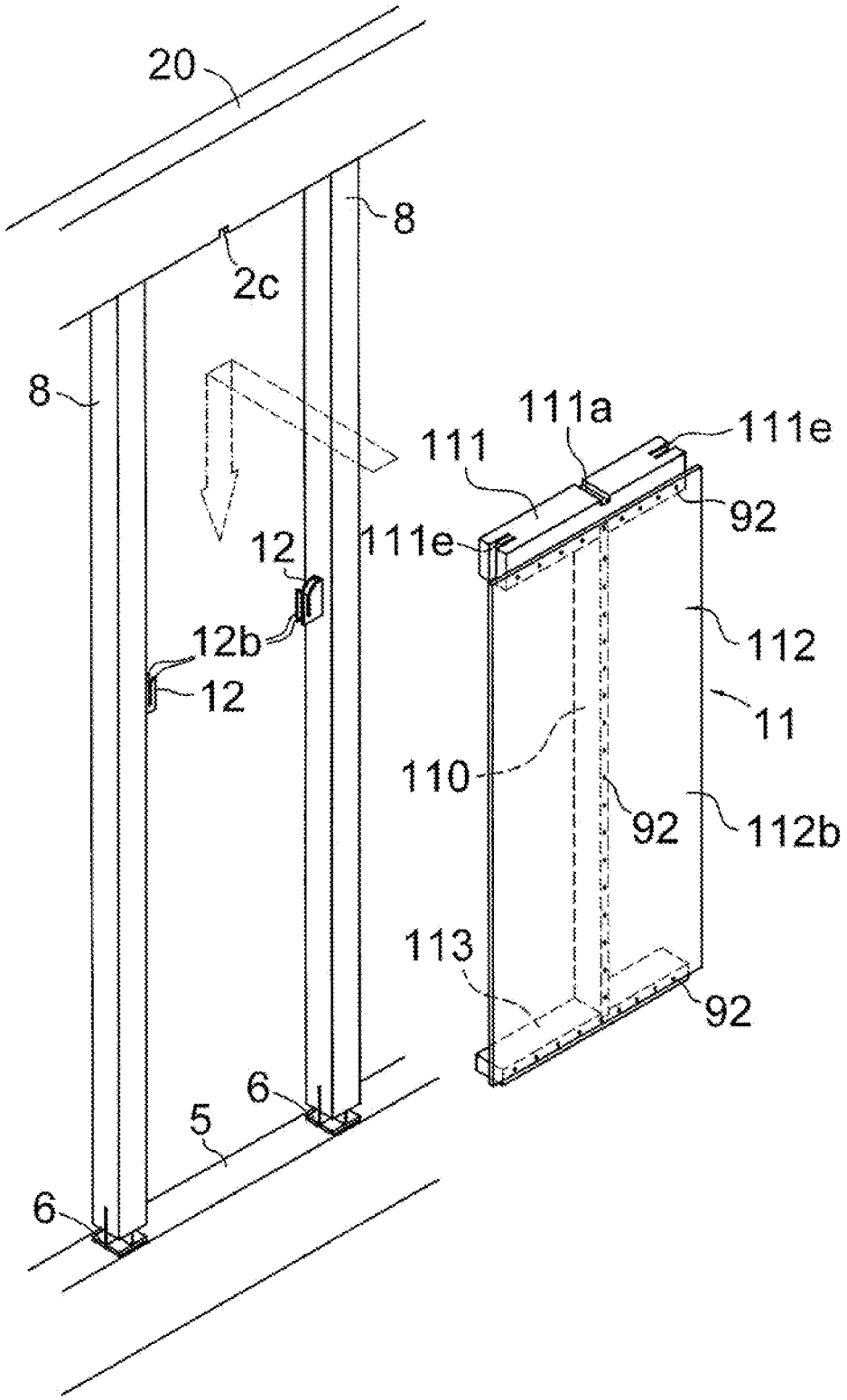

[FIG.11]
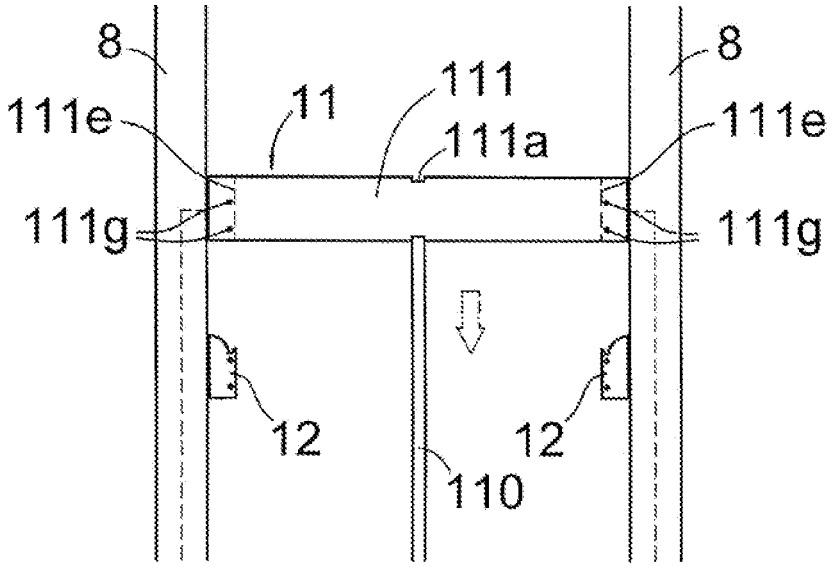
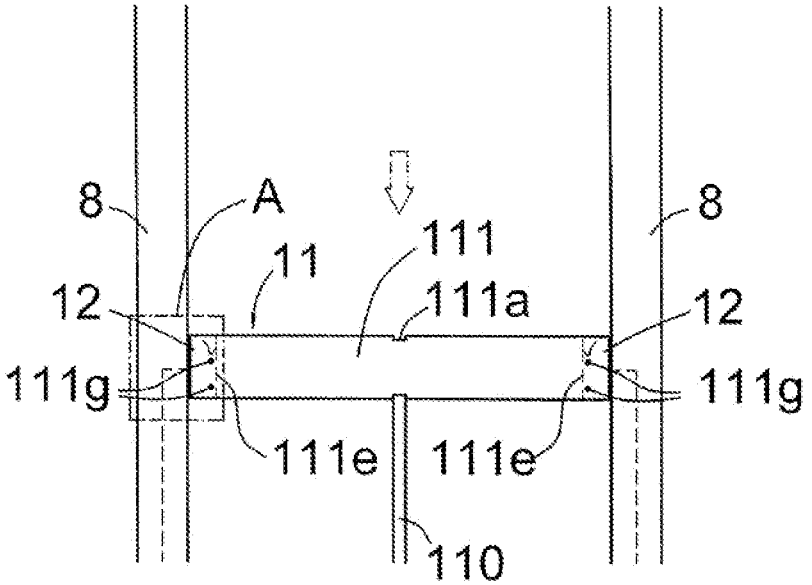

[FIG.12]
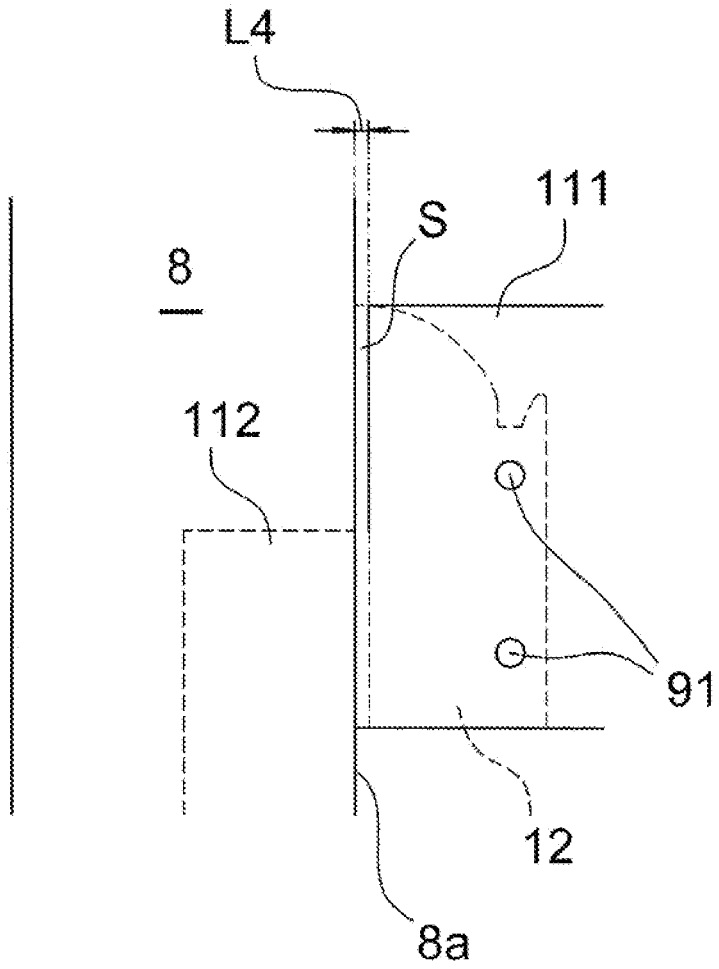

[FIG.13]
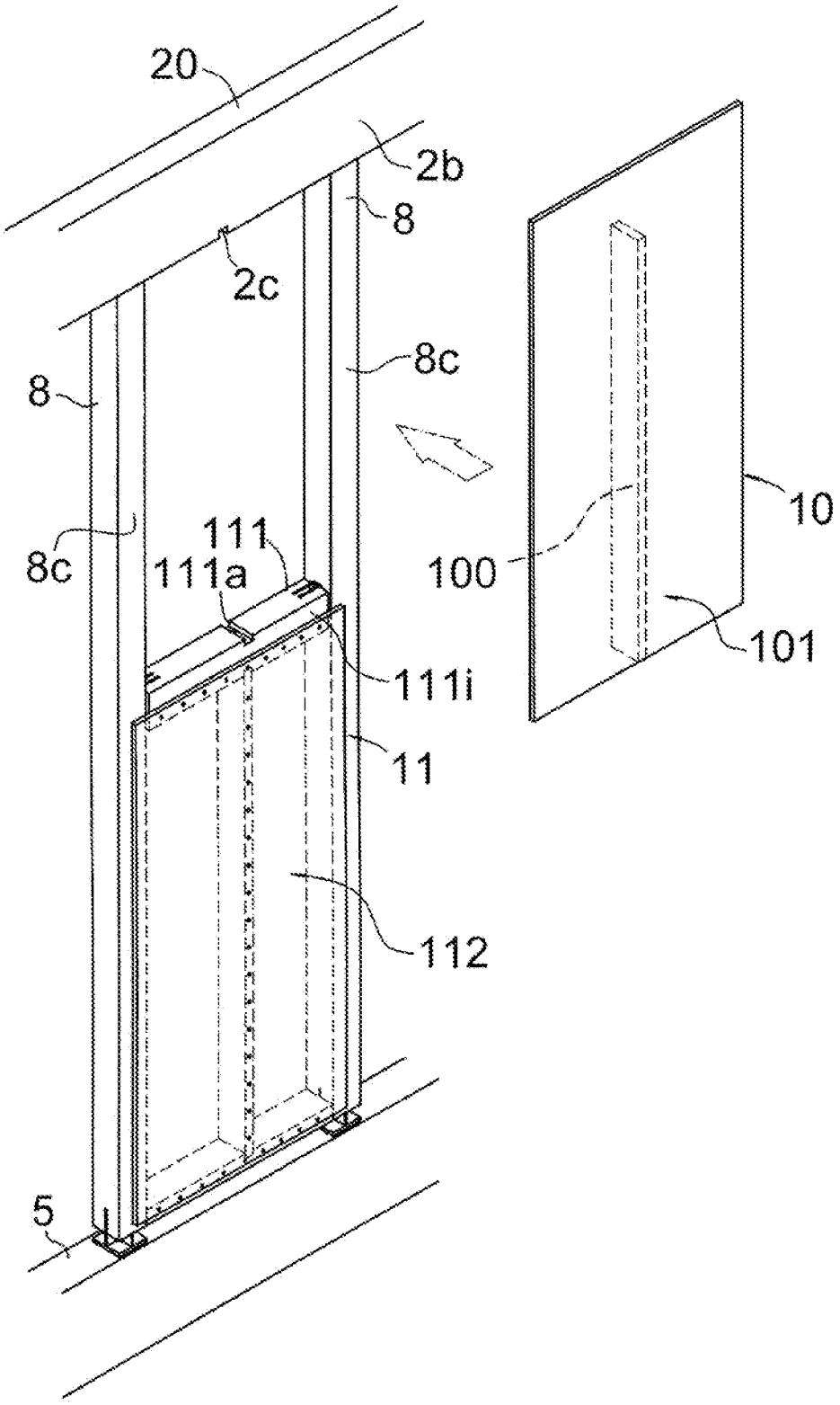

INSTALLATION AND CONSTRUCTION METHOD OF WALL PANEL

TECHNICAL FIELD

The present invention relates to an installation and construction method of a wall panel for installing the wall panel to a framework member, which is constituted of a pair of wooden columns and a wooden horizontal member, in a wooden framework construction method.

BACKGROUND ART

Conventionally, as bearing walls in wooden framework structures, there have been generally used bearing walls, each of which is formed by obliquely laying bracings to a framework member formed by installing wooden horizontal members such as girths and pole plates to a pair of wooden columns; and bearing walls, each of which is formed by integrating a framework member and a bearing surface member such as structural plywood. In general, when the bearing wall in which the framework member and the bearing surface member are integrated is formed, the formation of the bearing wall is conducted in the following procedure: the framework member is formed by installing a wooden horizontal member to the wooden columns; erection adjustment of the wooden columns is conducted; thereafter, the so-called common lumbers such as studs serving as a substrate member of the bearing surface member are installed to the framework member; and finally, the bearing surface member is fixed to the common lumbers and the framework member. On the other hand, there has been proposed a wall structure which is formed by carrying a wall panel, in which common lumbers and a surface member are previously integrated, in a construction site and directly fixing the wall panel to a framework member (for example, Patent Literatures 1 and 2).

CITATION LIST

Patent Literature

Patent Literature 1: JP 2016-125201 A
Patent Literature 2: JP 2010-121338 A

SUMMARY OF THE INVENTION

Technical Problems

Incidentally, when the common lumbers and the bearing surface member are separately installed to the framework member, since it takes time to form the framework member, the construction of the common lumbers and the bearing surface member is usually conducted over two consecutive days from a construction date of the framework member. In addition, it is often the case that installation of the common lumbers and the bearing surface member which can be constructed in a manner of a post-construction is left until later, and in many cases, after the framework member has been formed and the erection adjustment work of the wooden columns has been conducted, priority is given to construction of an upstairs floor and formation of an upstairs framework member. However, since the construction of the common lumbers and the bearing surface member is conducted outdoors as with the construction of the framework member, the construction of the common lumbers and the bearing surface member is susceptible to weather, and when the construction of the common lumbers and the bearing surface member is conducted separately from the construction of the framework member, it is likely that the whole processes are influenced and a construction period is thereby extended. Furthermore, in a case of a framework panel construction method in which the framework member, the common lumbers, and the bearing surface member are integrated, frame conditions of the wooden horizontal member of the framework member are frequently limited, which may be a cause to obstruct a projecting beam installed to configure a deep space under eaves. In order to address the above-described problems, a wall panel which is separated from the framework member and is constituted of only the common lumbers and the bearing surface member is used, so that a wall composite construction method, which causes no limitations on structural surfaces of wooden horizontal members constituting a floor slab and a roof, can be attained.

In addition, in the wall panel described in each of Patent Literatures 1 and 2, since the surface member and the common lumbers are preset in a factory, the surface members and the common lumbers can be easily fixed to the framework member, and working hours can be shortened. However, when erection adjustment of the wooden columns of the framework member is attempted after fixation to the wall panel, movement of the framework member is often obstructed by the wall panel, and the adjustment is thereby inhibited from being smoothly conducted. Thus, the problem arises that it takes time to conduct the erection adjustment of the wooden columns. Moreover, since edge end portions of the surface members of the wall panel are complicatedly enclosed by frame members, it is difficult to mutually join the surface members of the wall panel, and a panel width cannot be easily adjusted in accordance with a span between the wooden columns.

When pieces of structural plywood each having general standard dimensions are installed as the surface members to a pair of wooden columns whose span therebetween exceeds 1000 mm and a wooden horizontal member which forms a high ceiling, it is required to connect the surface members to each other in a horizontal direction or a vertical direction. However, when the respective members are separately constructed on a construction site, a number of members such as half columns and joining members for connecting the surface members to each other is increased, thereby resulting in a further increase in labor. In addition, also in a case where the wall panel is preset in a factory, when the wall panel is upsized in consideration of the span between the columns and a floor height, for example, because a size of the wall panel exceeds a size of a carrying capacity of a general transport truck and it is required to transport the wall panel by a further large-sized truck, a transportation cost is highly likely to be increased.

Hence, in view of the above-described problems, the present invention has been devised. It is an object of the present invention to provide an installation and construction method of a wall panel, in which the wall panel can be easily installed to a framework member formed by installing a wooden horizontal member to a pair of wooden columns and erection of the wooden columns constituting the framework member can be smoothly adjusted.

Solutions to the Problems

A first installation and construction method of a wall panel according to the present invention is an installation and construction method of a wall panel for installing the wall panel to a pair of wooden columns and a wooden horizontal member, the pair of wooden columns being installed in a standing manner so as to be spaced apart from each other, the wooden horizontal member being installed to the pair of wooden columns, the method comprising forming a plurality of concave fitting grooves extending from the edge end of a front surface side toward a rear surface direction on the lower end surface of the wooden horizontal member, spaced in the horizontal direction, forming the wall panel by connecting mutually adjacent end portions of a plurality of surface members in a horizontal direction by a half column extending in a vertical direction, studs being fixed on first plate surfaces of the plurality of surface members; and after installing the wooden horizontal member to the pair of wooden columns and adjusting erection of the wooden columns, fitting upper end portions of the studs and the half column into the respectively corresponding fitting grooves from the front surfaces side of the wooden columns and fixing edge end portions of the surface members of the wall panel to front surfaces of the pair of wooden columns and a front surface of the wooden horizontal member.

A second installation and construction method of a wall panel according to the present invention is an installation and construction method of a wall panel for installing the wall panel to a pair of wooden columns and a wooden horizontal member, the pair of wooden columns being installed in a standing manner so as to be spaced apart from each other, the wooden horizontal member being installed to the pair of wooden columns, the wall panel including a first panel having a stud being fixed on a first plate surface of a surface member, and a second panel having the stud on a first plate surface of the surface member and having a joining member being fixed on an upper end portion of the first plate surface of the surface member, the joining member extending in a horizontal direction, the method comprising installing the wooden horizontal member to the pair of wooden columns, fixing joining metal fittings on respective side surfaces of the pair of wooden columns, the side surfaces facing each other, disposing the joining member of the second panel between the pair of wooden columns and in a substantially center of a height direction of the pair of wooden columns, after spacing both end portions of the joining member in a longitudinal direction completely apart from the respective side surfaces of the pair of wooden columns at a predetermined interval, joining the both end portions of the joining member in a longitudinal direction to the respective side surfaces of the pair of wooden columns with the joining metal fittings, and adjusting erection of the wooden columns, the side surfaces facing each other, fixing edge end portions of the surface members of the second panel to front surfaces of the pair of wooden columns and a front surface of the wooden horizontal member, installing the first panel in a position higher than a position of the second panel; and fixing edge end portions of the surface members of the first panel to a front surface of the joining member, respective front surfaces of the pair of wooden columns and connecting the first panel and the second panel in a height direction.

In a third installation and construction method of a wall panel according to the present invention, the joining member is joined to the pair of wooden columns by inserting insert parts of the joining metal fittings into respective cut-in grooves being formed in both ends of the joining member in a longitudinal direction and penetrating the joining member together with the insert parts by drift pins.

A fourth installation and construction method of a wall panel according to the present invention, wherein the first panel and the second panel are formed by connecting and fixing the surface members of the first panel and the second panel in a horizontal direction by the half column, the first panel and the second panel having the studs being fixed on the first plate surfaces.

In a fifth installation and construction method of a wall panel according to the present invention, the respective cut-in grooves extend in a direction in which the cut-in grooves approach to each other from the both ends surfaces of the joining member in the longitudinal direction and are substantially concave grooves in plain view penetrating from an upper end surface of the joining member to a lower end surface of the joining member.

Advantageous Effects of Invention

In accordance with a first installation and construction method of a wall panel according to the present invention, since the wall panel is formed by mutually connecting the plurality of surface members, each of which has the stud fixed on first plate surfaces thereof, by the half column in the horizontal direction, the wall panel which can cope with various spans each between the wooden columns can be formed. Since the wall panel is previously integrated with the studs and the surface members, as compared with a case where the studs and the surface members are separately installed to the pair of wooden columns and the wooden horizontal member, a number of members can be reduced. Thus, hours required to construct the surface members on a construction site is shortened, and workability can be enhanced.

In accordance with a second installation and construction method of a wall panel according to the present invention, since the joining member of the second panel is joined between the pair of wooden columns; thereafter, the erection of the wooden columns is adjusted; and thereafter, the surface members are fixed to the front surfaces of the wooden columns and the front surface of the wooden horizontal member, movement of the wooden columns and the wooden horizontal members are not obstructed by the wall panel, and the erection adjustment of the wooden columns can be smoothly conducted. In addition, since framing of the pair of wooden columns and the wooden horizontal member, the erection adjustment of the wooden columns, and the construction of the wall panel can be conducted at the same timing, outdoor working hours, which are susceptible to weather, can be shortened. Furthermore, since the first panel and the second panel can be connected by the joining member, it is possible to cope with floor heights having various heights and various ceiling heights.

In accordance with a third installation and construction method of a wall panel according to the present invention, since the pair of wooden columns have the joining metal fittings fixed on the respective side surfaces facing each other and the insert parts of the joining metal fittings are inserted into the cut-in grooves formed in the both end portions of the joining member in the longitudinal direction, as long as accuracy of fitting the joining metal fittings to the wooden columns is ensured, accuracy of installing the joining member to the wooden columns can be ensured. Accordingly, leveling of the joining member can be simplified, and accuracy of fitting the wall panel can be easily enhanced as compared with a case where each of the members constituting the wall panel is separately fixed to the wooden columns. In addition, since the second panel which is a heavy member can be easily disposed in an appropriate position, workability can be enhanced.

In accordance with a fourth installation and construction method of a wall panel according to the present invention, since the first panel and the second panel are formed by connecting and fixing, in the horizontal direction by the half column, the surface members adjacent to each other in the horizontal direction, it is possible to cope with various spans between the wooden columns, and convenience can be enhanced.

In accordance with a fifth installation and construction method of a wall panel according to the present invention, since the joining member is joined to the pair of wooden columns in a state in which each of the both ends thereof in the longitudinal direction is spaced apart from each of the side surfaces of the pair of wooden columns, which face each other, at the predetermined interval, in a case where a horizontal force is exerted on the pair of wooden columns and each of the pair of wooden columns is thereby largely displaced in the horizontal direction, possibility that a large compression force of shearing is transmitted to a portion of each of the wooden columns, which crosses the joining member, and brittle buckling of the portion is caused can be reduced.

In accordance with a sixth installation and construction method of a wall panel according to the present invention, since each of the cut-in grooves of the joining member is penetrated from the upper end surface of the joining member to the lower end surface thereof, the insert parts can be easily inserted into the cut-in grooves only by dropping the joining member from above the joining metal fittings, and workability can be enhanced.

BRIEF DESCRIPTION OF THE DRAWINGS

FIG. 1 is a front view showing a bearing wall in a first embodiment.

FIG. 2 is a front view showing a column base part of each of wooden columns.

FIG. 3 is a perspective view showing a wall panel in the first embodiment.

FIG. 4 is a perspective view showing a state in which a wooden horizontal member is installed to the wooden columns in the first embodiment.

FIG. 5 is a front view showing a bearing wall in a second embodiment.

FIG. 6 is a front view showing a pair of wooden columns in the second embodiment.

FIG. 7 is a perspective view showing a first panel and a second panel.

FIG. 8 is a perspective view showing the first panel and the second panel, each of which is formed by connecting surface members adjacent to each other in a horizontal direction.

FIG. 9 is a perspective view showing each joining metal fitting.

FIG. 10 is a perspective view showing a state in which a joining member is joined to the pair of wooden columns.

FIG. 11 is a rear view showing a state in which the joining member is joined to the pair of wooden columns.

FIG. 12 is a rear view showing a portion A in FIG. 11 in a partially enlarged manner.

FIG. 13 is a perspective view showing a state in which the first panel is joined to the joining member.

DESCRIPTION OF EMBODIMENTS

Hereinafter, embodiments of an installation and construction method of a wall panel according to the present invention will be described with reference to the accompanying drawings. The installation and construction method of the wall panel in the present application is a construction method used when an architectural structure having a wooden framework structure is built and is mainly used to install the wall panel to a framework member located in a first floor outer peripheral portion of the architectural structure to form a bearing wall. It is to be noted that the installation and construction method of the wall panel in the present application is used not only in a case where the bearing wall of a building outer peripheral portion is formed but also in a case where a bearing wall or a normal partition wall inside a building is formed, and furthermore, the installation and construction method of the wall panel therein can be used for a bearing wall or a partition wall which is formed on a second or further upper floor, not limited for the bearing wall or the partition wall formed on the first floor. In each of the present embodiments, a case where a bearing wall of an outer peripheral portion on a building first floor will be described. In addition, in the present application, a "front surface" is a surface which is visible and a "rear surface" is a surface on a side opposite to the "front surface" in FIGS. 1 and 5.

First Embodiment

As shown in FIGS. 1 and 2, a bearing wall 4 is formed such that a framework member is formed by installing a wooden horizontal member 2 such as a pole plate and a girth to a pair of wooden columns 1 which are installed so as to be spaced apart from each other in a standing manner on a foundation 5; and a wall panel 3 formed by connecting surface members 31 adjacent to each other in a horizontal direction, by a half column 32 extending in a vertical direction, is fixed to the framework member.

As shown in FIGS. 1 and 2, the pair of wooden columns 1 are long vertical members which are installed in the standing manner on an upper end surface of the foundation 5 via column base metal fittings 6 fixed on respective lower ends of the pair of wooden columns. A span L1 between the wooden columns 1 is equal to or greater than 1000 mm and less than 4000 mm. Each of the column base metal fittings 6 is constituted of a base 61, which is fixed onto the foundation 5 by anchor bolts 51 protruding from the upper end surface of the foundation 5; and a supporting part 62 which supports a lower end portion of each of the wooden columns 1. Each of the column base metal fittings 6 is fixed integrally with each of the wooden columns 1 by inserting an insert plate 62*a* of the supporting part 62, which protrudes upward, into a cut-in groove (not shown) formed in a lower end of each of the wooden columns 1 and penetrating each of the wooden columns 1 and the insert plate 62*a* by drift pins 91. In addition, the foundation 5 is formed by placing concrete on a construction site, and since erection of the pair of wooden columns 1, which are installed in the manner standing thereon, depends on a construction accuracy of the foundation 5, it is required to adjust the erection thereof on the site.

As shown in FIG. 1, the wall panel 3 is a panel member which is installed over the whole range enclosed by the pair of wooden columns 1 and the wooden horizontal member 2. As shown in FIG. 3, the wall panel 3 has: a plurality of surface members 31; the half column 32 which connects the plurality of surface members 31 to each other in the horizontal direction; studs 33 which are fixed on first plate surfaces 31*a* of the surface members 31 and extend in a vertical direction; and a lower frame member 34 which is fixed over a lower end portion of the first plate surfaces 31*a* of the surface members 31 and edge ends of the surface members 31 and extends in a horizontal direction.

Each of the surface members 31 is formed by using a plate material such as structural plywood and a particle board which are excellent in shearing performance, and a width of each of the surface members 31 is approximately 900 mm to 1000 mm and a height thereof is approximately 3030 mm or less. As shown in FIGS. 1 and 3, the half column 32 is disposed over edge end portions of the surface members 31 adjacent to each other in a horizontal direction and on the first plate surfaces 31*a* of the surface members 31. The half column 32 is fixed onto the surface members 31 by engaging fixtures 92 such as screws and nails from the side of second plate surfaces 31*b* of the surface members 31, whereby the plurality of surface members 31 can be connected to each other and fixed. In addition, the half column 32 has a length substantially the same as a length from an upper end surface of the lower frame member 34 to a lower end surface of the beam member 2 in a state in which the wall panel 3 is installed to the wooden columns 1 and the wooden horizontal member 2. A lower end portion of the half column 32 is fitted into a first fitting groove 34*a* formed on the upper end surface of the lower frame member 34 and an upper end portion thereof is fitted into a second fitting groove 2*a* formed on the lower end surface of the wooden horizontal member 2. As shown in FIG. 1, the surface members 31, which are connected to each other and fixed by the half column 32, cover a part of front surfaces 1*a* of the pair of wooden columns 1 and a front surface 2*b* of the wooden horizontal member 2 and are fixed by the engaging fixtures 92 such as the screws and nails.

The studs 33 and the lower frame member 34 shown in FIGS. 1 and 3 are so-called common lumbers, which assist the surface members 31, and serve as substrate members of the surface members 31. Each of the studs 33 is disposed in a substantially center of a width direction of the first plate surface 31*a* and is fixed to the surface member 31 by the engaging fixtures 92 from the side of the second plate surface 31*b* of the surface member 31. In addition, each of the studs 33 has a length which is substantially the same as a length of the half column 32, a lower end portion of each of the studs 33 is fitted into a third fitting groove 34*b* formed on the upper end surface of the lower frame member 34, and an upper end portion thereof is fitted into a fourth fitting groove 2*c* formed on the lower end surface of the wooden horizontal member 2. As with the studs 33, the lower frame member 34 is fixed onto the first plate surfaces 31*a* of the surface members 31 by the engaging fixtures 92, and the half column 32 and the studs 33 are sandwiched between the lower frame member 34 and the wooden horizontal member 2.

By connecting the surface members 31 to each other by the half column 32 in the horizontal direction, the wall panel 3 configured as described above can be formed as a panel member which can cope with a case where the span L1 between the wooden columns 1 exceeds 1000 mm. Accordingly, since the wall panel 3 can be formed by using the structural plywood and the particle board each having general standard dimensions, a panel member which is excellent in convenience and economical performance can be formed.

Next, the installation and construction method of the bearing wall 4 will be described. The wall panel 3 which is formed by previously assembling the surface members 31, the half column 32, the studs 33, and the lower frame member 34 in a factory is carried into a construction site. As shown in FIG. 4, the pair of wooden columns 1 are installed on the foundation 5 formed by placing the concrete on the construction site, the long wooden horizontal member 2 extending in the horizontal direction is installed thereacross, and the wooden horizontal member 2 is fixed to the pair of wooden columns 1 by heretofore known dedicated metal fittings (not shown).

Subsequently, the erection of the pair of wooden columns 1 which is influenced by a construction accuracy of the upper end surface of the foundation 5 is adjusted, and as shown in FIG. 1, finally, the upper end portions of the half column 32 and the studs 33 of the wall panel 3 are fitted into the respectively corresponding fitting grooves 2*a* and 2*c* of the wooden horizontal member 2 from the side of the front surfaces 1*a* of the wooden columns, and the part of the front surfaces 1*a* of the wooden columns 1 and the front surface 2*b* of the wooden horizontal member 2 is covered with the surface members 31 and the fixation by the engaging fixtures 92 is conducted, thereby completing the bearing wall 4. As described above, since the members constituting the wall panel 3 are previously integrated, as compared with a case where the studs 33 and the surface members 31 are separately installed to the pair of wooden columns 1 and the wooden horizontal member 2, the bearing wall 4 allows a construction period of the panel member on the construction site to be shortened. In addition, since a width of the wall panel 3 can be easily adjusted without subjecting the members to complicated processing, the panel member which is excellent in the convenience and reduces manufacturing costs can be formed.

Second Embodiment

Next, as the second embodiment, a bearing wall 7 will be described with reference to the accompanying drawings. It is to be noted that description as to the same components as those in the first embodiment will be omitted. As shown in FIG. 5, the bearing wall 7 is formed by fixing a wall panel 9, which is formed by joining a first panel 10 and a second panel 11, to a framework member which is formed by installing a wooden horizontal member 20 to a pair of wooden columns 8.

As shown in FIG. 6, as with the wooden columns 1 in the first embodiment, the pair of wooden columns 8 are long vertical members which are installed in a standing manner to an upper end surface of a foundation 5 via column base metal fittings 6. Since erection of the wooden columns 8 depends on a construction accuracy of the foundation 5, it is required to adjust the erection thereof on a construction site. In addition, in the wooden columns 8, a plurality of first through-holes 8*b* penetrating from first side surfaces 8*a* toward side surfaces on opposite sides are formed in substantially the same height positions as each other. It is to be noted that a span between the wooden columns 8 is the same as that between the wooden columns 1, and the wooden horizontal member 20 is formed to have the same configuration as that of the wooden horizontal member 2 in the first embodiment except that the second fitting groove 2*a* is not formed.

As shown in FIG. 5, the wall panel 9 is a panel member which is installed over the whole range enclosed by the pair of wooden columns 8 and the wooden horizontal member 20. As shown in FIG. 7, the wall panel 9 includes the first panel 10 which is formed by fixing a first stud 100 onto a first plate surface 101*a* of a first surface member 101 and the second panel 11 which is formed by fixing a second stud 110 onto a first plate surface 112*a* of a second surface member 112 and fixing a joining member 111, which extends in a horizontal direction, onto an upper end portion of the first plate surface 112*a*. In addition, since configurations of the first surface member 101 and the second surface member 112 are the same as that of the surface member 31 in the first embodiment, description therefor will be omitted hereinafter.

As shown in FIGS. 5 and 7, the first panel 10 is a panel member which is installed in a position higher than a position of the second panel 11. The first stud 100 is disposed in a substantially center of a width direction of the first plate surface 101*a* of the first surface member 101 and is fixed to the first surface member 101 by engaging fixtures 92 from the side of a second plate surface 101*b* of the first surface member 101. In addition, the first stud 100 has substantially the same length as a length from a lower end surface of the wooden horizontal member 20 to an upper end surface 111*c* of the joining member 111 of the second panel 11 in a state in which the wall panel 9 is installed to the wooden columns 8 and the wooden horizontal member 20. An upper end portion of the first stud 100 is fitted into a fourth fitting groove 2*c* formed in a lower end surface of the wooden horizontal member 20 and a lower end portion thereof is fitted into a fifth fitting groove 111*a* formed in an upper end surface 111*c* of the joining member 111.

As shown in FIGS. 5 and 7, the second panel 11 is a panel member which is disposed below the first panel 10, and in a lower end portion of the second surface member 112, a lower frame member 113 which extends in a horizontal direction is installed. The second stud 110 is disposed in a substantially center of the first plate surface 112*a* of the second surface member 112 and is fixed to the second surface member 112 by engaging fixtures 92 from the side of a second plate surface 112*b* of the second surface member 112. In addition, the second stud 110 has substantially the same length as a length from a lower end surface 111*d* of the joining member 111 to an upper end surface of the lower frame member 113 in the state in which the wall panel 9 is installed to the wooden columns 8 and the wooden horizontal member 2. A lower end portion of the second stud 110 is fitted into a sixth fitting groove 111*b* formed in the lower end surface 111*d* of the joining member 111 and a lower end portion thereof is fitted into a seventh fitting groove 113*a* formed in an upper end surface of the lower frame member 113.

As shown in FIGS. 5 and 7, the joining member 111 is disposed in an upper end portion of the second surface member 112 and is fixed to the second surface member 112 by the engaging fixtures 92 from the side of the second plate surface 112*b*. In addition, both end portions of the joining member 111 in a longitudinal direction can be joined to the pair of wooden columns 8 by joining metal fittings 12 which are fixed to the pair of wooden columns 8. As shown in FIG. 7, both ends of the joining member 111 in the longitudinal direction are provided with cut-in grooves 111*e* which extend in a direction in which the cut-in grooves 111*e* approach to each other from the both end, penetrate from the upper end surface 111*c* to the lower end surface 111*d*, and are substantially U-shaped in a plan view. The both ends of the joining member 111 in the longitudinal direction are also provided with second through-holes 111*g* which penetrate from a side of a front surface 111*i* contacting the second surface members 112 to a direction of a rear surface 111*f* located opposite to the front surface 111*i*. A length L2 of the joining member 111 shown in FIG. 7 is formed to be shorter than a first distance L3 between the first side surfaces 8*a* of the pair of wooden columns 8 shown in FIG. 5, and for example, it is preferable that the length L2 is formed to be approximately 10 mm shorter than the first distance L3. Setting the above-mentioned length allows the joining member 111 to be easily installed to the pair of wooden columns 8.

It is to be noted that as shown in FIG. 8, a panel width can be adjusted by connecting a plurality of panels 10 and 11 in a horizontal direction. Specifically, the first surface members 101 adjacent to each other in the horizontal direction are connected and are fixed by a first half column 102 extending in a vertical direction, thereby adjusting the width of the first panel 10, and the second surface members 112 adjacent to each other in the horizontal direction are connected and are fixed by a second half column 114 extending in a vertical direction, thereby adjusting the width of the second panel 11. As described above, the surface members 101 and 112 are connected in the horizontal direction by the half columns 102 and 114, respectively, whereby the wall panel 9, which can cope with also the case where the span between the pair of wooden columns 1 exceeds 1000 mm, can be formed. In addition, it is preferable that a width of each of the panels 10 and 11 is 2000 mm or less, and such a width allows the panels 10 and 11 to be flatly stacked on a small truck (4*t*) and transported.

The joining metal fittings 12 shown in FIG. 9 are substantially U-shaped metal fittings for joining the joining member 111 of the second panel 11 to the pair of wooden columns 8. Each of the joining metal fittings 12 is constituted of a contact part 12*a* which is fixed to the side surface 8*a* of each of the pair of wooden columns 8 by bolts 93 and a pair of insert parts 12*b* which protrude from both ends of the contact part 12*a* in a width direction to a side of the facing wooden column and are inserted into the cut-in grooves 111*e* of the joining member 111. Each of the contact part 12*a* and insert parts 12*b* has substantially the same height as that of the joining member 111. In the contact part 12*a*, third through-holes 12*c* which penetrate in a plate thickness direction are formed in positions which coincide with positions of the first through-holes 8*b* formed in each of the wooden columns 8 shown in FIG. 5. In leading end portions of the insert parts 12*b*, fourth through-holes 12*d* which penetrate in the plate thickness direction are formed in positions which coincide with positions of the second through-holes 111*g* of the joining member 111 in a state in which the insert parts 12*b* are inserted into the joining member 111.

Next, an installation and construction method of the bearing wall 7 will be described. First, as shown in FIG. 10, the wooden horizontal member 20 is fixed to the pair of wooden columns 8, which are installed on the foundation 5 in a standing manner, by conventionally known dedicated metal fittings (not shown), and subsequently, the joining metal fittings 12 are attached. As shown in FIG. 9, each of the joining metal fittings 12 is attached to each of the pair of wooden columns 8 by bringing the contact part 12*a* into contact with each of the first side surfaces 8*a* of the wooden columns 8, causing the bolts 93 to penetrate through each of the wooden columns 8 and the contact part 12*a* with the first through-holes 8*b* formed in each of the wooden columns 8 and the third through-holes 12*c* coinciding with each other, and fastening each of the joining metal fittings 12 thereto by nuts 94.

As shown in FIGS. 10 and 11, the joining member 111 of the second panel 11 is dropped from above the joining metal fittings 12, the insert parts 12*b* of the joining metal fittings 12 are inserted into the cut-in grooves 111*e*, the second through-holes 111*g* and the fourth through-holes 12*d* of the insert parts 12*b*, shown in FIG. 9, are penetrated by drift pins 91 from the side of the rear surface 111*f* of the joining member 111, and the joining member 111 is engaged to the pair of wooden columns 8. As described above, since the length L1 of the joining member 111 is formed to be shorter than the first distance L3 between the pair of wooden columns 8, the joining member 111 can be easily installed between the pair of wooden columns 8. Since the joining member 111 is joined to the wooden columns 8 by the joining metal fittings 12 as described above, as long as accuracy of fitting the joining metal fittings 12 to the wooden columns 8 is ensured, accuracy of installing the joining member 111 to the wooden columns 8 can be ensured. Accordingly, leveling of the joining member 111 can be simplified, and accuracy of fitting the wall panel 9 can be easily enhanced as compared with a case where each of the members constituting the wall panel 9 is separately fixed to the wooden columns 8. In addition, since the cut-in grooves 111*e* of the joining member 111 are caused to penetrate from the upper end surface 111*c* to the lower end surface 111*d*, only by the joining member 111 is dropped from above the joining metal fittings 12, the second panel 11 which is a heavy member can be easily fitted into the joining metal fittings 12, and workability can be enhanced. It is to be noted that at this stage, the second panel 11 is in a state in which the joining member 111 is only engaged to the wooden columns 8, and the second surface member 112 is not fixed to the wooden columns 8.

It is to be noted that as shown in FIG. 12, it is preferable that each of the both ends of the joining member 111 in the longitudinal direction is spaced apart from each of the first side surfaces 8*a* at a predetermined interval and a gap S is formed. Normally, in a case where a horizontal force is exerted on the pair of wooden columns 1, a compression force of shearing is transmitted to a portion of each of the wooden columns 8, which crosses the joining member 111, and the portion is easily buckled. However, by forming the above-mentioned gap S, each of the wooden columns 8 being strongly pressed by an edge end of the joining member 111 and causing brittle buckling can be suppressed to some degree. In addition, as shown in FIG. 12, it is preferable that a separation distance L4 between the edge end of the joining member 111 and each of the first side surfaces 8*a* of the wooden columns 8 is set to approximately 5 mm, and such a distance can reduce possibility that the brittle buckling of the wooden columns 8 is caused.

Next, the erection of the wooden columns 8 which is influenced by the construction accuracy of the upper end surface of the foundation 5 is adjusted. At this time, as described above, although the joining member 111 of the second panel 11 is engaged to the pair of wooden columns 8 by the joining metal fittings 12, the second surface member 112 is not fixed to the wooden columns 8. Thus, movement of the pair of wooden columns 8 and the wooden horizontal member 20 is not obstructed by the second panel 11, and the erection of the wooden columns 8 can be smoothly adjusted. In addition, since framing of the wooden horizontal member 20 is not limited by the second panel 11, it is possible to keep a degree of freedom in designing such as installing, for example, a horizontal member such as another wooden beam to the wooden horizontal member 20. After completing the erection adjustment of the wooden columns 8, as shown in FIG. 13, the second surface member 112 is fixed to the wooden columns 8 and the wooden horizontal member 20 by the engaging fixtures 92, the upper end portion of the stud 100 of the first panel 10 is fitted into the fourth fitting groove 2*c* of the wooden horizontal member 20 from the side of a front surface 8*c* of each of the wooden columns 8, a lower end portion of the stud 100 is fitted into the fifth fitting groove 111*a* of the joining member 111, a part of the front surface 111*i* of the joining member 111, the front surface 8*c* of each of the wooden columns 8 and a front surface 2*b* of the wooden horizontal member 20 are covered with the first surface member 101 as shown in FIG. 5, and the first surface member 101 is fixed by the engaging fixtures 92, thereby completing the bearing wall 7.

As described above, in the installation and construction method of the wall panel in the present application, movement of the framework member is not obstructed by the wall panel 9. Thus, framing of the pair of wooden columns 8 and the wooden horizontal member 20, the erection adjustment of the wooden columns 8, and the construction of the wall panel 9 can be conducted at the same timing, whereby outdoor working hours, which are susceptible to weather, can be shortened. Since the joining member 111 is joined by the pair of wooden columns 8 and the joining metal fittings 12, the leveling of the joining member 111 can be simplified, and the accuracy of fitting the wall panel 9 can be easily enhanced as compared with the case where each of the members constituting the wall panel 9 is separately fixed to the wooden columns 8. In addition, since the installation and construction method of the wall panel in the present application is also applicable to a case of forming a bearing wall or a partition wall inside an architectural structure other than the case of forming the bearing wall of the building outer peripheral portion, a construction method which is excellent in convenience can be attained.

Embodiments of the present invention are not limited to the above-described embodiments, and appropriate modifications can be made without departing from the scope of the concept of the present invention.

INDUSTRIAL APPLICABILITY

An installation and construction method of a wall panel according to the present invention can be favorably used when a bearing wall of a building outer peripheral portion is formed.

DESCRIPTION OF REFERENCE SIGNS

1, 8 wooden columns
1*a*, 8*c* front surface (of wooden columns)
8*a* first side surfaces (of the pair of wooden columns)
2, 20 wooden horizontal member
2*b* front surface (of the wooden horizontal member)
3, 9 wall panel
31 surface members
31*a* first plate surfaces (of the surface members)
32 half column
33 studs
10 first panel
100 first stud
101 first surface member
101*a* first surface member (of a first surface member)
102 first half column (half column)
11 second panel
110 second stud
111 joining member
111*c* upper end surface (of the joining member)
111*d* lower end surface (of the joining member)
111*e* cut-in grooves
111*i* front surface (of the joining member)
112 second surface member
112*a* first plate surface (of a second surface member)

114 second half column (half column)
12 joining metal fittings
12*b* insert parts
91 drift pins

The invention claimed is:

1. An installation and construction method of a wall panel for installing the wall panel to a pair of wooden columns and a wooden horizontal member, the pair of wooden columns being installed in a standing manner so as to be spaced apart from each other, the wooden horizontal member being installed to the pair of wooden columns, the wall panel including: a first panel having a stud being fixed on a first plate surface of a surface member; and a second panel having the stud on a first plate surface of the surface member and having a joining member being fixed on an upper end portion of the first plate surface of the surface member, the joining member extending in a horizontal direction, the method comprising:

installing the wooden horizontal member to the pair of wooden columns;

fixing joining metal fittings on respective side surfaces of the pair of wooden columns, the side surfaces facing each other;

disposing the joining member of the second panel between the pair of wooden columns and in a substantially center of a height direction of the pair of wooden columns;

after spacing both end portions of the joining member in a longitudinal direction completely apart from the respective side surfaces of the pair of wooden columns at a predetermined interval, joining the both end portions of the joining member in a longitudinal direction to the respective side surfaces of the pair of wooden columns with the joining metal fittings, and adjusting erection of the wooden columns, fixing edge end portions of the surface members of the second panel to front surfaces of the pair of wooden columns and a front surface of the wooden horizontal member;

installing the first panel in a position higher than a position of the second panel; and fixing edge end portions of the surface members of the first panel to a front surface of the joining member, respective front surfaces of the pair of wooden columns, and connecting the first panel and the second panel in a height direction.

2. The installation and construction method of a wall panel according to claim 1, wherein the joining member is joined to the pair of wooden columns by inserting insert parts of the joining metal fittings into respective cut-in grooves being formed in both ends of the joining member in a longitudinal direction and penetrating the joining member together with the insert parts by drift pins.

3. The installation and construction method of a wall panel according to claim 2, wherein the first panel and the second panel are formed by connecting and fixing the surface members of the first panel and the second panel in a horizontal direction by the half column, the first panel and the second panel having the studs being fixed on the first plate surfaces.

4. The installation and construction method of a wall panel according to claim 1, wherein the first panel and the second panel are formed by connecting and fixing the surface members of the first panel and the second panel in a horizontal direction by the half column, the first panel and the second panel having the studs being fixed on the first plate surfaces.

* * * * *